US006135362A

United States Patent [19]

Purdy

[11] Patent Number: 6,135,362

[45] Date of Patent: Oct. 24, 2000

[54] IRRIGATION SYSTEM RISER ASSEMBLY

[76] Inventor: Nicholas R. Purdy, 3901 S. Sutton Way, Boise, Id. 83706

[21] Appl. No.: 09/428,604

[22] Filed: Oct. 27, 1999

[51] Int. Cl.[7] ..... B05B 15/06

[52] U.S. Cl. ..... 239/200; 239/202; 239/280.5; 239/DIG. 1

[58] Field of Search ..... 239/14.2, 200, 239/201, 202, 206, 210, 273, 276, 280, 67, 69, 101, DIG. 1, DIG. 15; 4/615, 568, 570; 138/155; 137/487.5; 417/44.2

[56] References Cited

U.S. PATENT DOCUMENTS 1,111,692 9/1914 Harvey et al. ..... 239/280

3,825,186 7/1974 Heenan et al. ..... 239/280

5,836,516 11/1998 Van Epps et al. ..... 239/280

*Primary Examiner*—Andres Kashnikow

*Assistant Examiner*—Lisa Ann Douglas

*Attorney, Agent, or Firm*—Joseph W. Holland

[57] ABSTRACT

A riser assembly for an irrigation system, including a first riser segment attached to a supply line and a second riser segment attached to the first riser segment at a first end and to a sprinkler at the second end. The riser assembly also includes a control valve which may be inserted between the second riser segment and a sprinkler gun. The various segments and the control valve and sprinkler are all coupled employing mechanical couplings which permit a degree of flexion at the coupling or joint. The first riser segment is formed of a section of PVC pipe and the second riser section is formed of a segment of copper alloy pipe.

16 Claims, 4 Drawing Sheets

IRRIGATION SYSTEM RISER ASSEMBLY

BACKGROUND OF THE INVENTION

1. Technical Field

The present invention relates generally to irrigation systems and more particularly to a stand pipe and head configuration for use in connection with a livestock irrigation system.

2. Background

Irrigation is the term given to that mechanism by which water is supplied, typically through a system of conduits including pipe, to ground which is relatively arid. In livestock feedlot environments where literally thousands of animals may be penned in relatively close proximity to one another for the purpose of holding the animals for feeding prior to sale to market, irrigation has proven to be of substantial utility. Advantages of feedlot irrigation include minimization of dust and resulting dust clouds which can produce respiratory problems not only for the cattle but for individuals which may live or work in surrounding areas. Dust and dust clouds may also cause eye and skin irritation both in animals and in humans who may live or work in surrounding areas. It has been shown that feedlot irrigation lowers ground temperatures between 10° F. and 15° F. which in turn lowers the feed animal's body temperature. The use of feedlot irrigation also helps control bacteria levels which is beneficial to the feed animal and the feed lot operator in terms of lower rate of disease spread and lower death losses. Weight gain is increased when feedlot irrigation is used because feed animals tend to eat more regularly in a temperature controlled environment. Additionally, irrigation systems for feedlot irrigation may be used to broadcast insecticides to control pests in the feedlot environment.

Irrigation systems for feedlot irrigation differ from those typically used in agricultural settings in that these systems must be built to withstand the abuse that they may receive from the livestock, particularly the vertical portions of the system, or risers. A system for feedlot irrigation typically includes a main water supply line which may be connected to a grid of underground piping having a plurality of vertical members, or risers each of which are connected to a water supply line. A sprinkler head is connected at the upper end of the riser for dispensing water over the desired area, typically in a spray or other dispersed fashion. A control valve may be connected between the upper end of the riser and the sprinkler permitting control of flow and/or pressure through the sprinkler head.

Historically, the water supply piping and the riser have been fashioned employing galvanized steel pipe. The riser typically attaches to the water supply line using a fitting such as a 90° elbow or a fitting having a "T" configuration. A variety of coupling methods have been employed including threaded, welded and mechanical connections including sealed clamping devices. Alternatively, polyvinylchloride (PVC) piping has been used for the supply piping and the riser. In another embodiment of the prior art, a galvanized steel riser has been coupled to the water supply. As these systems operate at relatively high pressures, on the order of 200 pounds per square inch, any failure in the piping has a catastrophic potential.

It would be advantageous to provide a riser assembly which has greater strength, ductility and resistance to impact than the current galvanized steel systems being employed. It would also be advantageous to provide for reinforced control valve assembly and an alignment mechanism for aligning the control valve with riser.

SUMMARY OF THE INVENTION

A riser assembly for an irrigation system, includes a first riser segment having a first coupling end and a second coupling end, the first coupling end being attached to a supply line. The riser assembly also includes a second riser segment attached to the first riser segment at a first end and to a sprinkler at the second end. The riser assembly may also include a control valve which may be inserted between the second riser segment and the sprinkler.

In the preferred embodiment of the invention, the various segments and the control valve and sprinkler are all coupled employing mechanical couplings which permit a degree of flexion at the coupling or joint. Mechanical connectors such as those manufactured by the Victaulic® Company of America for use with a square groove have proven acceptable for the described application.

Oftentimes, irrigation systems for livestock employ reclaimed water which may be highly corrosive, therefore, in the preferred embodiment of the invention, the first riser segment is formed of a section of PVC pipe, preferably schedule 80, and the second riser section is formed of a segment of copper alloy pipe, preferably a K-type or schedule 40. These materials in combination, installed as detailed below, have proven to provide a corrosion resistant, durable and impact resistant assembly which is suitable for the feedlot environment.

Additional advantages and novel features of the invention will be set forth in part in the description that follows, and in part will become apparent to those skilled in the art upon examination of the following, or may be learned by practice of the invention. The advantages of the invention may be realized and attained by means of the instrumentalities and combinations particularly pointed out in the appended claims.

DETAILED DESCRIPTION OF THE INVENTION

Figure 1:
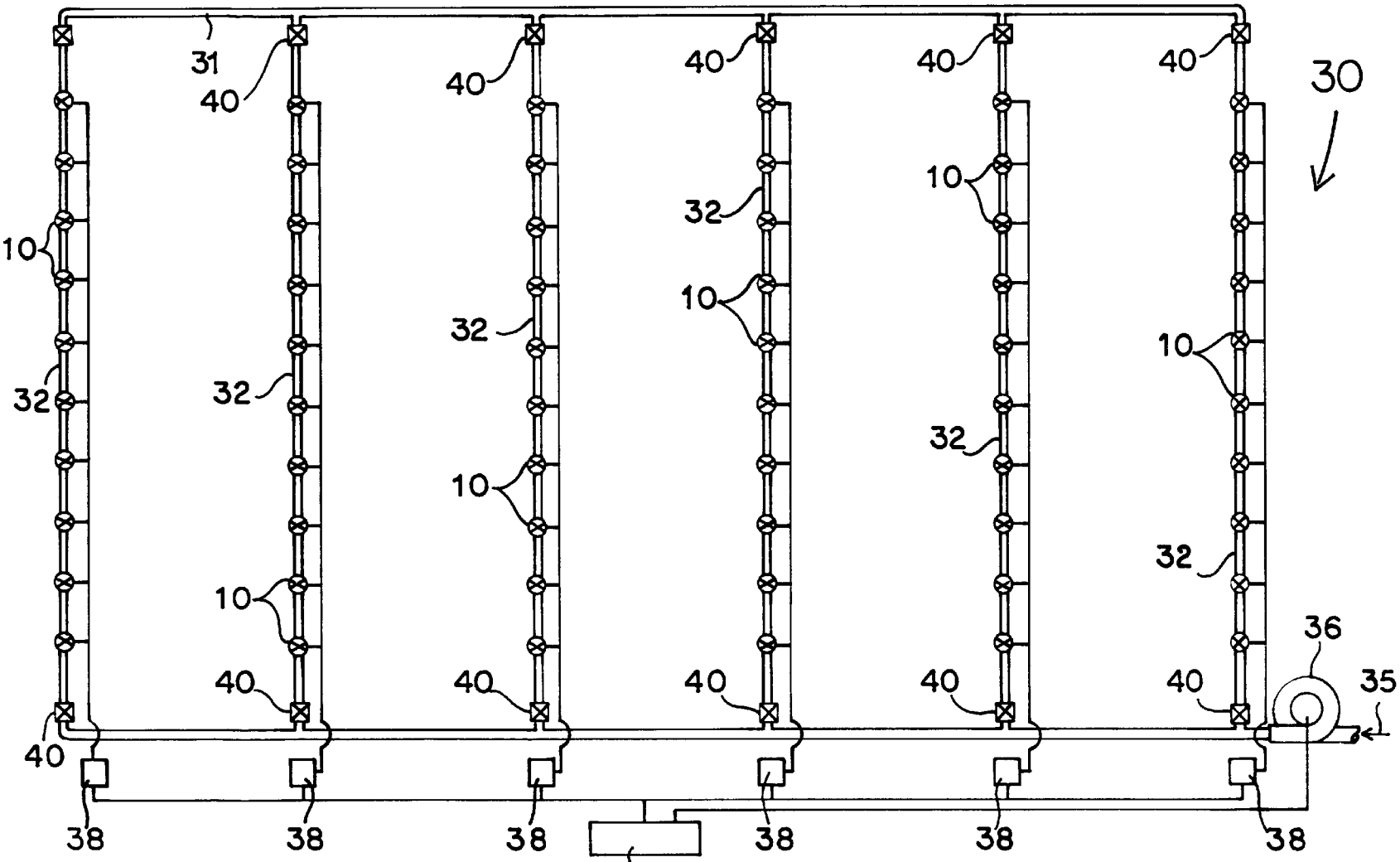
FIG. 1 is a perspective schematic representation of an irrigation system according to the present invention.

Referring to FIG. 1, irrigation system 30 is shown including a main supply loop 31 which feeds a plurality of branch lines 32. A plurality of riser assemblies 10 may be arranged along the branch lines 32. FIG. 1 also shows main supply loop 31 fluidly connected to water supply 35 through pump 36. In the preferred of the invention, pump 36 includes a variable frequency pump which has proved to be superior in maintaining constant line pressure within irrigation system 30. Irrigation system 30 also includes processor 37 for controlling the various functions of irrigation system 30 and controllers 38 for controlling flow through circuits including one or more control valves (not shown in FIG. 1).

In the preferred embodiment of the invention, main supply loop 31 is configured as a loop and each branch line 32 is isolated by a pair of shut-off valves 40, one located at each of the two ends of each branch line 32. Water is supplied in this manner to main supply line loop 31, each branch line 32 and each sprinkler riser assembly 10 from each of the two ends of each branch line 32. Each branch line 32 may be isolated as needed to provide repair without suspending operation of irrigation system 30.

Figure 2:
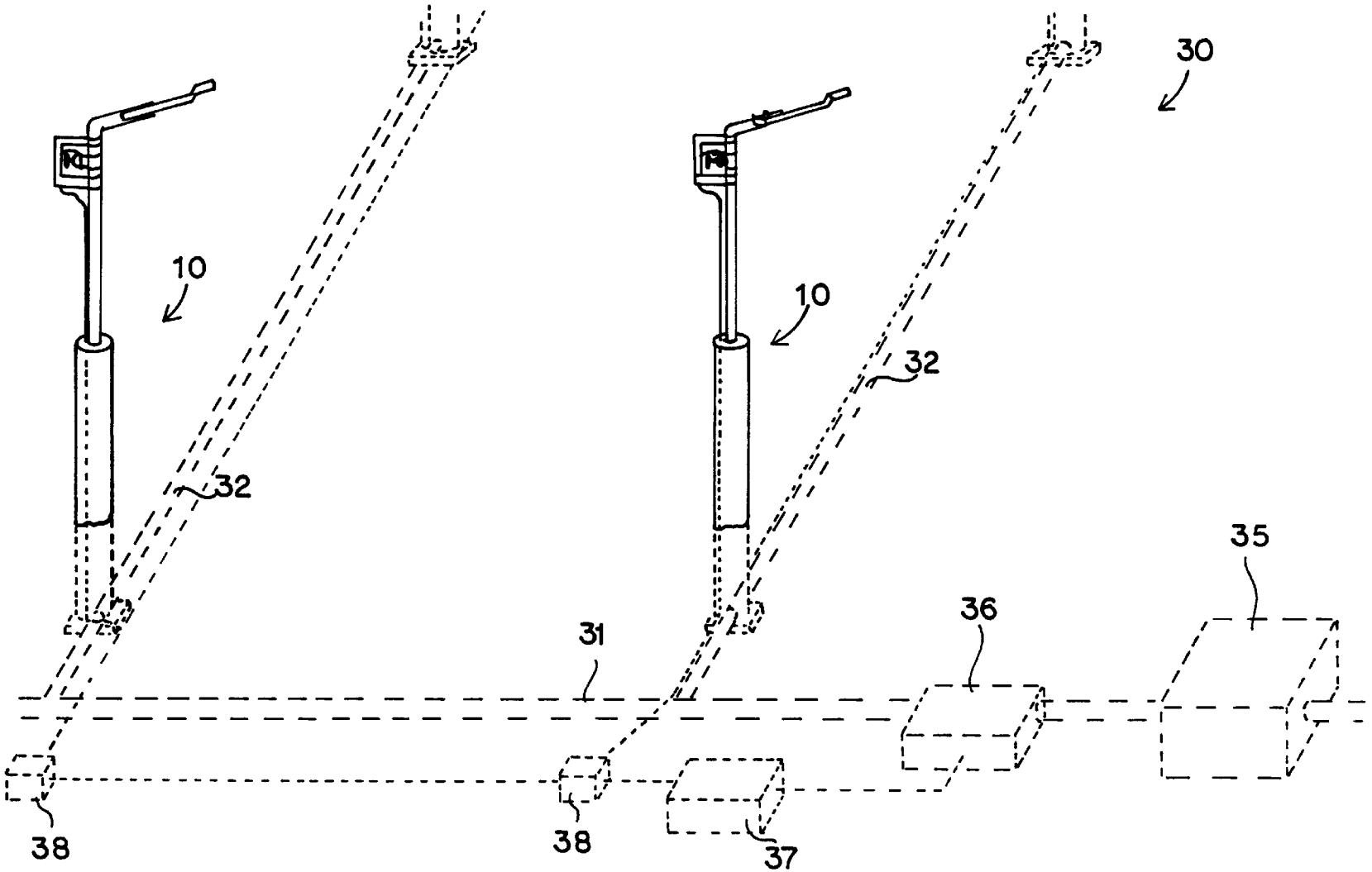
FIG. 2 is a perspective representation of an irrigation system according to the present invention.

Referring to FIG. 2, irrigation system 30 is shown including a main supply loop 31 which feeds a plurality of branch lines 32. A plurality of riser assemblies 10 may be arranged along either of the branch lines 32 or the main supply loop 31. FIG. 2 also shows main supply loop 31 fluidly connected to water supply 35 through pump 36. In the preferred of the invention, pump 36 includes a variable frequency pump which has proved to be superior in maintaining constant line pressure within irrigation system 30.

Figure 3:
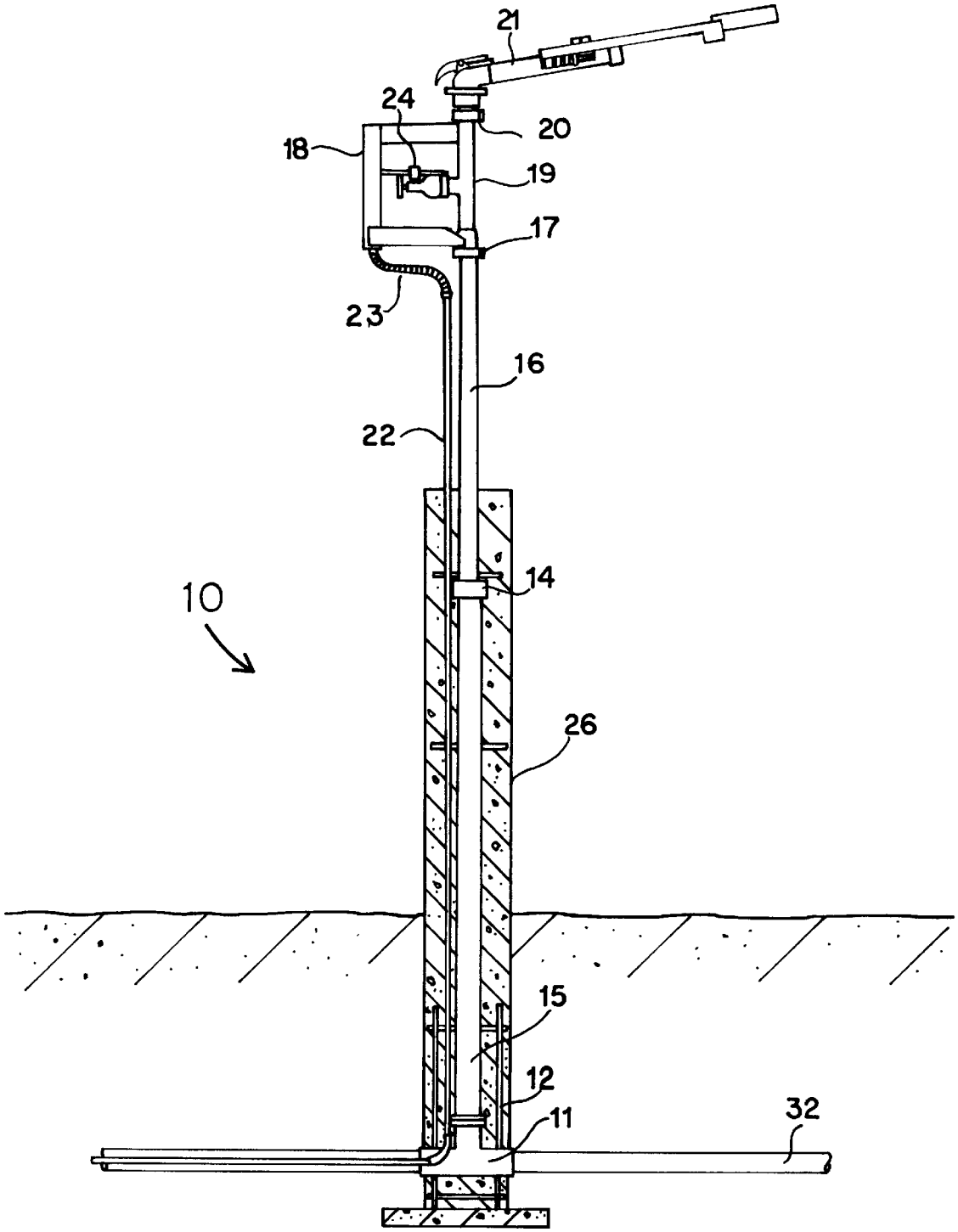
FIG. 3 is a perspective representation of a riser assembly for an irrigation system according to the present invention.

Referring to FIG. 3, sprinkler riser assembly 10 is shown attached to branch line 32. More specifically, first riser segment 15 is coupled to fitting 11 by first mechanical coupling 12. Similarly, second riser segment 16 is fluidly coupled to first riser segment 15 by second mechanical coupling 14. In the preferred embodiment of the invention, first riser segment 15 is formed of a PVC pipe and second riser segment 16, is formed from copper pipe.

Control valve 24 is connected to the second end of the second riser segment by coupler 19 by third mechanical coupling 17. Fourth mechanical coupling 20 attaches sprinkler gun 21 to the upper end of control valve 24. In the preferred embodiment of the invention, sprinkler gun 21 includes an irrigation manufactured by the Nelson Company. Sprinkler gun 21 is configured to emit either a circular or a partial circular pattern. Also, in the preferred embodiment of the invention, and for applications in which the line pressure is less than 200 p.s.i, control valve 24 includes a Rainbird brand PES/PRS scrubber valve. Alternatively, and for applications in which the line pressure exceeds 200 p.s.i, control valve 24 includes an INBAL Pressure Regulating Valve manufactured by Mill Limited. In the preferred embodiment of the invention, first mechanical coupling 12, second mechanical coupling 14, third mechanical coupling 17 and fourth mechanical coupling 20 are all water tight mechanical couplings manufactured by Victaulic® Company of America.

In the preferred embodiment of the invention, third mechanical coupling 17 and fourth mechanical coupling 20 are held in spaced apart relationship by support bracket 18 which provides additional rigidity to the system. In addition, bracket 18 is configured to allow electrical wiring contained in conduit 22 and flex 23 to pass through the bracket to a control valve 24. Riser assembly 10 may also include concrete pier 26 into which first riser segment 15 and pipe fitting 11 are cast. Additionally, the lower portion of second riser segment 16 is cast within concrete pier 26 to provide additional rigidity and protection to riser 16 above ground level.

FIG. 3 also shows concrete pier 26 including reinforcing and stabilizing members.

Figure 4:
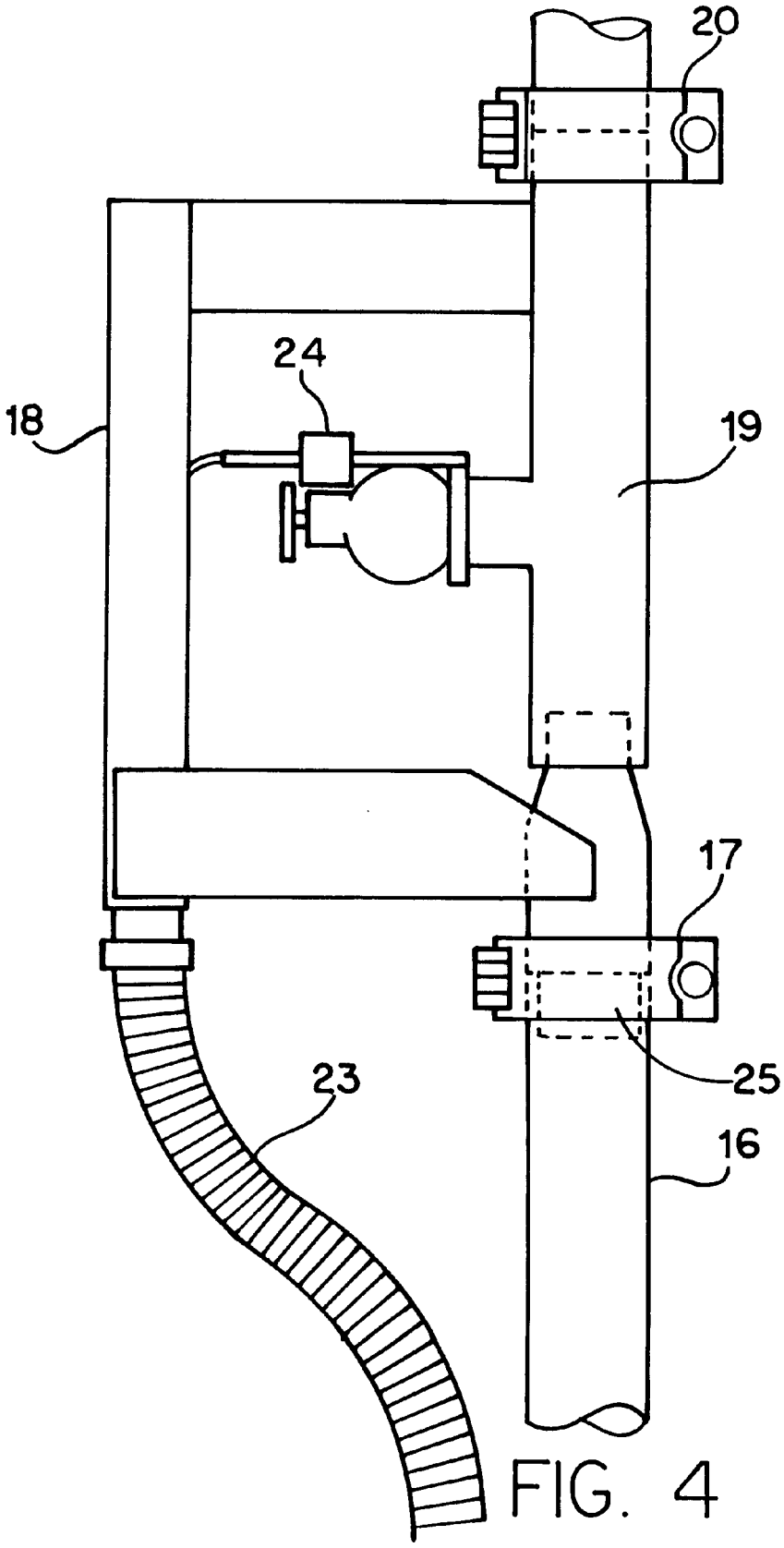
FIG. 4 is a perspective representation of a control valve assembly and coupling for a riser assembly according to the present invention.

Referring to FIG. 4, third mechanical coupling 17 and fourth mechanical coupling 20 are held in spaced apart relationship by support bracket 18. Bracket 18 is configured to allow electrical wiring contained in conduit 22 and flex 23 to pass through the bracket to control valve 24. Fourth mechanical coupling 20 attaches sprinkler gun 21 to the upper end of control valve 19. Third mechanical coupling 17 is shown including collar 25 which extends within and is attached to the inner circumferential wall of third mechanical coupling 17. Collar 25 assists alignment and connection of coupler 19 to second riser segment 16 by third mechanical coupling 17.

It is therefore contemplated that the appended claims will cover any such modifications or embodiments as fall within the scope of the invention.

I claim:

1. A riser assembly for an irrigation system comprising:

a first riser segment including a first riser segment first coupling end and a first riser segment second coupling end, the first riser segment first coupling end attached to a fitting second coupling end;

a pier encasing at least a portion of the first riser segment;

a second riser segment including a second riser segment first coupling end and a second riser segment second coupling end, the second riser segment first coupling end attached to the first riser segment second coupling end;

a first coupling for coupling the second riser segment first coupling end in fluid communication with the first riser segment second coupling end;

a control valve including a valve body first coupling end and a valve body second coupling end, the valve body first coupling end attached to the second riser segment second coupling end;

a second coupling for coupling the second riser segment second coupling end in fluid communication with the valve body first coupling end;

a sprinkler attached to the valve body second coupling end; and a third coupling for coupling the valve body second coupling end in fluid communication with the sprinkler.

2. The riser assembly of claim 1 wherein the first riser segment further comprises a section of PVC pipe.

3. The riser assembly of claim 1 wherein the second riser segment further comprises a section of copper alloy pipe.

4. The riser assembly of claim 1 wherein the valve body first coupling end further comprises an alignment collar.

5. The riser assembly of claim 1 wherein the first coupling, the second coupling and the third coupling further comprise mechanical connectors.

6. The riser assembly of claim 1 wherein the sprinkler further comprises an impact gun.

7. The riser assembly of claim 1 wherein the control valve further comprises a flow regulator.

8. The riser assembly of claim 1 further comprising a reinforcement bracket.

9. An irrigation system comprising:

a variable frequency pump;

a supply line including a supply line coupling end;

a fitting including a fitting first coupling end and a fitting second coupling end, the fitting first coupling end attached to the supply line;

a supply line coupling for coupling the fitting first coupling end in fluid communication with the supply line coupling end;

a first riser segment including a first riser segment first coupling end and a first riser segment second coupling end, the first riser segment first coupling end attached to the fitting second coupling end;

a second riser segment including a second riser segment first coupling end and a second riser segment second coupling end, the second riser segment first coupling end attached to the first riser segment second coupling end;

a first coupling for coupling the second riser segment first coupling end in fluid communication with the first riser segment second coupling end;

a control valve including a valve body first coupling end and a valve body second coupling end, the valve body first coupling end attached to the second riser segment second coupling end;

a second coupling for coupling the second riser segment second coupling end in fluid communication with the valve body first coupling end;

a sprinkler attached to the valve body second coupling end; and a third coupling for coupling the valve body second coupling end in fluid communication with the sprinkler; and a processing device connected to the variable frequency pump for maintaining constant line pressure, the processing device also connected to the control valve for regulating flow.

10. The riser assembly of claim 9 further comprising a reinforcement bracket.

11. The riser assembly of claim 9 wherein the first riser segment further comprises a section of PVC pipe.

12. The riser assembly of claim 9 wherein the second riser segment further comprises a section of copper alloy pipe.

13. The riser assembly of claim 9 further comprising a concrete pier encasing at least a portion of the first riser segment.

14. The riser assembly of claim 9 wherein the supply line coupling, the first coupling, the second coupling and the third coupling further comprise mechanical connectors.

15. The riser assembly of claim 9 wherein the sprinkler further comprises an impact gun.

16. The riser assembly of claim 9 wherein the control valve further comprises a flow regulator.

* * * * *